United States Patent [19]

Svenning et al.

[11] Patent Number: 4,805,549

[45] Date of Patent: Feb. 21, 1989

[54] DEVICE FOR SUBSEA OPERATIONS

[75] Inventors: Bjornar Svenning, Trondheim, Norway; Rune Svensson, Höllviksnäs; Lars Truedesson, Klagstorp, both of Sweden

[73] Assignee: Den norske stats oljeselskap a.s, Norway

[21] Appl. No.: 131,337

[22] Filed: Dec. 9, 1987

Related U.S. Application Data

[63] Continuation of Ser. No. 838,118, Mar. 10, 1986, abandoned.

[30] Foreign Application Priority Data

Mar. 11, 1985 [NO] Norway ..... 850957

[51] Int. Cl.[4] ..... B63B 1/02

[52] U.S. Cl. ..... 114/325; 114/342

[58] Field of Search ..... 114/312, 313, 315, 61, 114/321, 322, 341, 342, 325, 256, 257

[56] References Cited

U.S. PATENT DOCUMENTS

| | | | |
|---|---|---|---|
| 3,390,655 | 7/1968 | Quady | 114/321 |
| 3,677,212 | 7/1972 | Gregoire | 114/321 |
| 3,809,002 | 5/1979 | Nagy | 114/322 |
| 3,848,558 | 11/1974 | Henry . | |
| 4,147,124 | 4/1979 | Brooks | 114/321 |
| 4,333,414 | 6/1982 | Hauz | 114/322 |
| 4,357,764 | 11/1982 | Lemercier | 114/321 |

FOREIGN PATENT DOCUMENTS

| | | |
|---|---|---|
| 2812758 | 9/1979 | Fed. Rep. of Germany . |
| 598988 | 5/1978 | Switzerland . |
| 218627 | 10/1924 | United Kingdom . |

*Primary Examiner*—Sherman D. Basinger
*Assistant Examiner*—Clifford T. Bartz
*Attorney, Agent, or Firm*—Lucas & Just

[57] ABSTRACT

A device for carrying out works under water includes a twin hull submarine (1,2) which can be combined with a number of specially adapted cargo modules (12), in which the twin hull submarine between its two hulls (1,2) is provided with a cargo holder (15) for carrying cargo modules in the compartment between the two hulls (1,2). This provides a modularized system for subsea operations, whereby a twin hull submarine, in combination with a number of specially adapted cargo modules, forms a device for carrying out various tasks under water.

8 Claims, 4 Drawing Sheets

DEVICE FOR SUBSEA OPERATIONS

This is a continuation of application Ser. No. 838,118, filed Mar. 10, 1986, now abandoned.

This invention relates to a device for executing subsea operations, especially related to operations of various kinds on subsea oil and gas fields.

Today operations on installations on the seabed are carried out by means of equipment and personnel which are lowered down from a surface vessel. With increasing depth, for instance 300 m or deeper, placing of material with the needed precision, bringing down personnel, supplying electric energy, hydraulic energy, gas etc. will be gradually more difficult. Moreover, the use of a surface vessel will make one strongly dependent on the weather conditions on the surface.

According to the invention a device for executing subsea operations is therefore suggested. This device is characterized by being a twin hull submarine which can be combined with a number of specially adapted cargo modules, and which hull is provided with a cargo holder between its two hulls to carry the cargo modules in the space between the two hulls.

In this way the invention provides a modularized system for subsea operations, in which a twin hull submarine, in combination with a number of specially adapted cargo modules, make up a tool for executing different tasks subsea. The submarine carries the cargo modules, one by one, in a special cargo holder between the hulls.

The invention makes it possible to carry out planned tasks of various kinds on a given oil or gas field. The submarine is based at a suitable port on the coast, where loading and unloading, maintenance and filling of bunker takes place. The submarine makes it possible to operate within a system where one to a largest possible extent at all times is operating in a submerged stage (coming out-performing operations-going in to the base). In this way one will be independent on weather conditions at the surface, such as heavy sea, strong wind, floating ice, etc. This applies to coming and going to and from the working site as well as during the time when working.

Employment of larger submarines for this kind of service is known. However, when the known submarines are supposed to carry heavy and voluminous cargos, it is commonly a prerequisite that these kind of cargos are carried beneath the submarine or at least outside the hulls of the submarine or outside its hydrodynamic external hull. This means that the hydrodynamic nature of the submarine is influenced in a strongly negative direction when carrying any such cargo.

With the submarine according to the invention, even voluminous cargos and cargos having odd corners may be carried without considerably slowing down the speed of the submarine or reduction in endurance.

The purpose of known projects based on the employment of larger submarines for carrying out subsea operations, have generally been to carry out single operations, for instance cleaning of pipelines, sluicing of divers etc. This can be accomplished according to the invention by utilizing a single submarine, which by use of different cargo modules can be made to carry out various tasks without modification or alteration of the submarine.

The cargo modules can have an external shape making it fitting into the general external shape of the submarine, preferably however, the space between the two hulls of the submarine can externally be limited by hatches or the like incorporated into the external hydrodynamic hulls of the submarine. In this way one will achieve independence of the external shape of the cargo modules.

The cargo holder preferably includes securing means for a cargo module fixed to the submarine; these securing means are either located along the imagined edges of a parallelepiped (the geometry of a container). Correspondingly the individual cargo modules are provided with equivalently located securing points or securing means. Thus, the cargo module may have a shape of a container or may be included in a framework where securing points are placed.

Suitably the cargo holder may include a frame being turnable on a cross shaft. Such a turnable frame, which may be included in addition to other cargo holder devices, which generally is meant to be included in the word cargo holder, makes a rotation of a cargo module placed in the frame possible. Amongst other things this makes it possible to place a cargo module in a position above a hatch on the bottom side of the room between the two hulls of the submarine.

Further suitable means for securing submodules may preferably be included, such submodules may comprise various units, by way of example production modules.

The cargo modules can by way of example comprise a monobaric work compartment, equipment for making measurements, or a compartment for core drilling equipment. Said types of cargo modules are only mentioned as examples of cargo modules which may be included in the modularized system for subsea works.

A cargo module for "wet" cargo may for instance be designed as a framework with securing points/means for the cargo, and handling gears, for instance winches, for the cargo. When the submarine has been located at the desired spot above the seabed, or on a subsea installation, any bottom hatches are opened and the cargo can be lowered by the handling gear. Conversely cargo can be loaded on board in the same way.

The submarine is preferably provided with means for supplying the individual cargo module with the necessarily energy, gas etc.

Preferably the pressure hull of the submarine is provided with a mating flange intended for making a connection with a similar mating flange in a cargo module.

Preferably the invention includes a cargo module formed as a monobaric work chamber divided into compartments, namely a machinery compartment and a work compartment. The machinery compartment is intended to be kept constantly dry at normal atmospheric pressure and is provided with a mating flange for connection to a similar mating flange of the submarine in a position rotated 90° on a horizontal cross shaft. The work compartment will normally be filled with water of ambient pressure during transport and application on the site of work. After being rotated 90° the monobaric work compartment can be lowered to a position underneath the submarine, for cooperation with a sealing surface or connection on a subsea installation. As soon as sealing and connection is established, the pressure of the work compartment can be lowered to normal work pressure and emptied. Personnel from the submarine can enter the machinery compartment when the chamber is in a vertical lowered work position. Personnel may from the machinery compartment be admitted to the work compartment.

Another cargo module may by way of example be formed as an instrumentation compartment. Such a compartment comprises a pressure resistant section into which personnel from the submarine may enter. The compartment will be locked to the cargo holder during use. Besides instruments and data equipment etc. the compartment may contain a machinery section which includes electrical supply, airconditioning, etc.

A cargo module may by way of example also be formed as a compartment for core drilling equipment. After the placement of the submarine on the seabed, one may turn the compartment to an upright position by means of a pivoted frame and then proceed with the drilling.

Said examples of cargo modules are only meant to be illustrative and are not to be regarded as restricting in any sense. One will reealize that the invention provides a device for carrying out operations under water. The invention may also be designated as a modularized system for subsea operations.

The invention will now be described in more detail with reference to the drawings, where:

Figure 1:
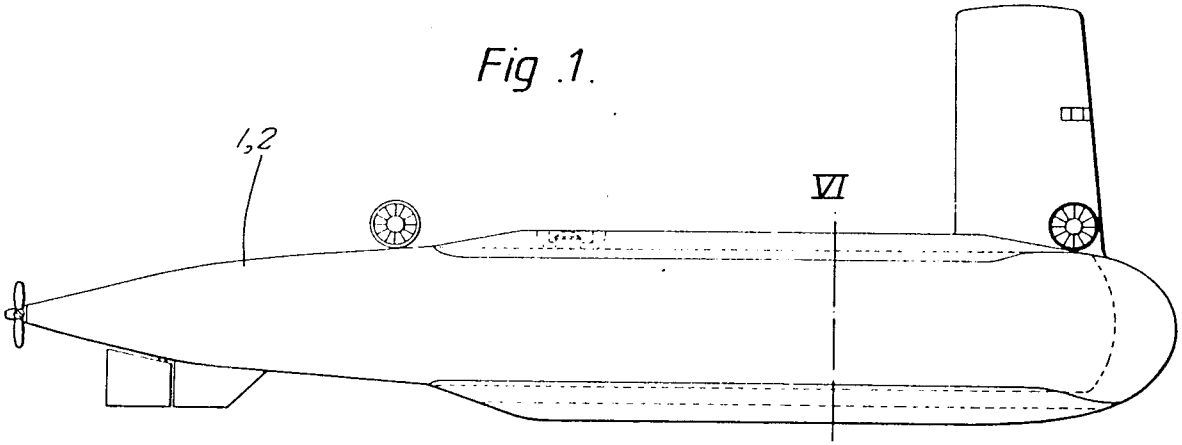
FIG. 1 shows a schematic side view of a twin hull submarine of the invention.
Figure 2:
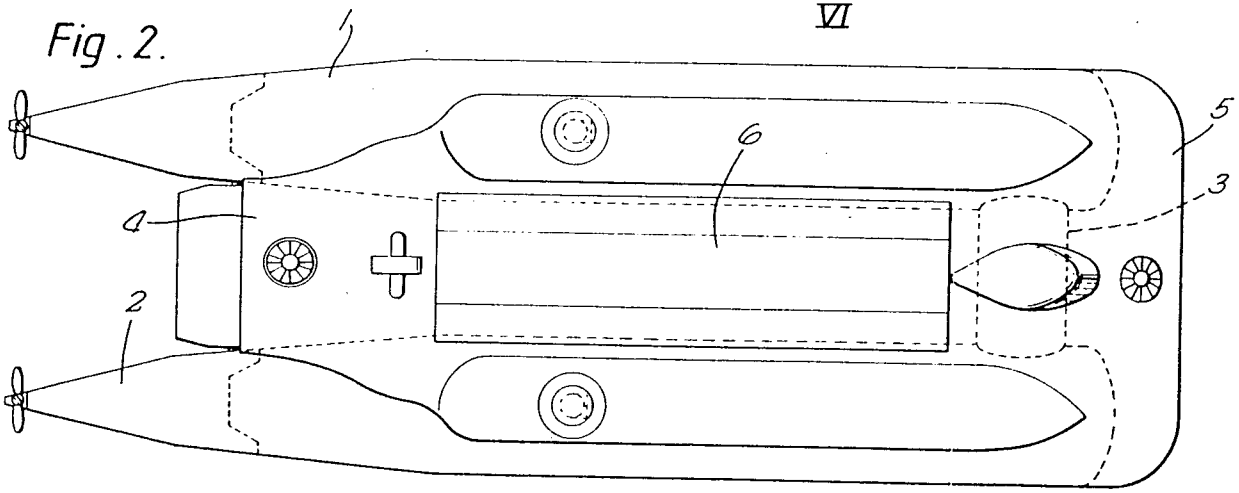
FIG. 2 shows the submarine in FIG. 1 viewed from above.
Figure 3:
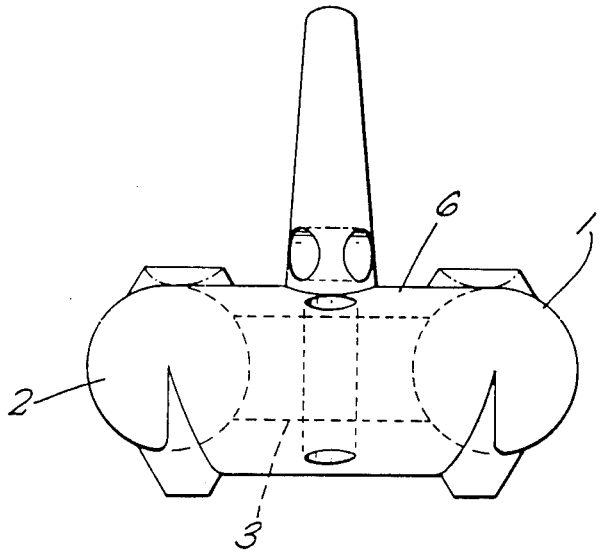
FIG. 3 shows the submarine in frontal view.

The twin hull submarine shown in FIG. 1–4 has two independent pressure hulls 1 and 2. The pressure hulls are connected to each other in the front by a transversal pressure hull section 3. In the rear part the pressure hulls 1, 2 are connected to each other by means of a suitable connection 4. This can be formed as a pressure resistant or pressure equalized section. The two pressure hulls 1, 2 are moreover surrounded by and connected to each other by means of an external hull 5, in which the rear part of the connecting part 4 may form an integral part of said external hull.

Between the pressure hulls 1, 2 there is in this way created a compartment 6. This compartment is provided with securing means (not shown) being located along the imagined edges of a parallelepiped, intended for carrying of and cooperating with a cargo module (not shown), having a similar box or container shape and being provided with securing points or securing means arranged along the edges corresponding to similar means in the compartment between the two hulls.

Figure 4:
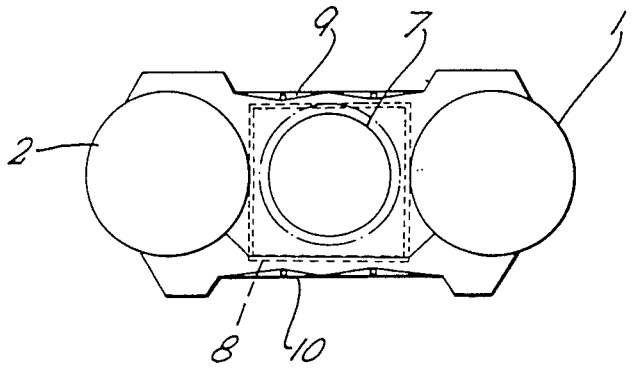
FIG. 4 shows a section along line VI—VI in FIG. 1.

In the section in FIG. 4 a cargo module having a generally circum-cylindrical shape is shown. This cargo module is designated by 7 and is provided with connecting points or securing means along its rectangular outline as shown with broken lines and designated by 8.

The compartment 6 is provided with upper 9 and lower 10 hatches which are either pivoted or are able to be moved sideways, in this way making the compartment assessable both from above and from below or by making it totally open, whereby a open space is created between the hulls 1 and 2.

Figure 5:
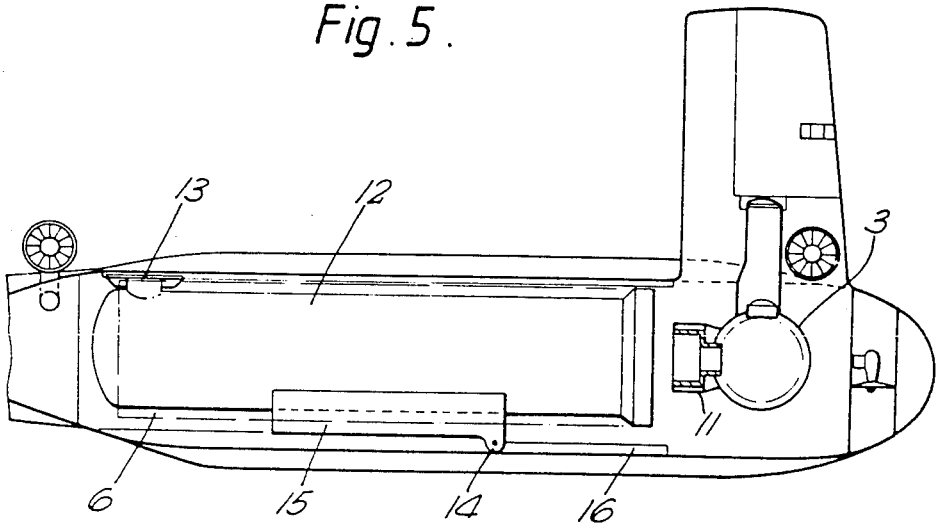
FIG. 5 shows schematically a section through a modified embodiment of the submarine in FIG. 1.
Figure 6:
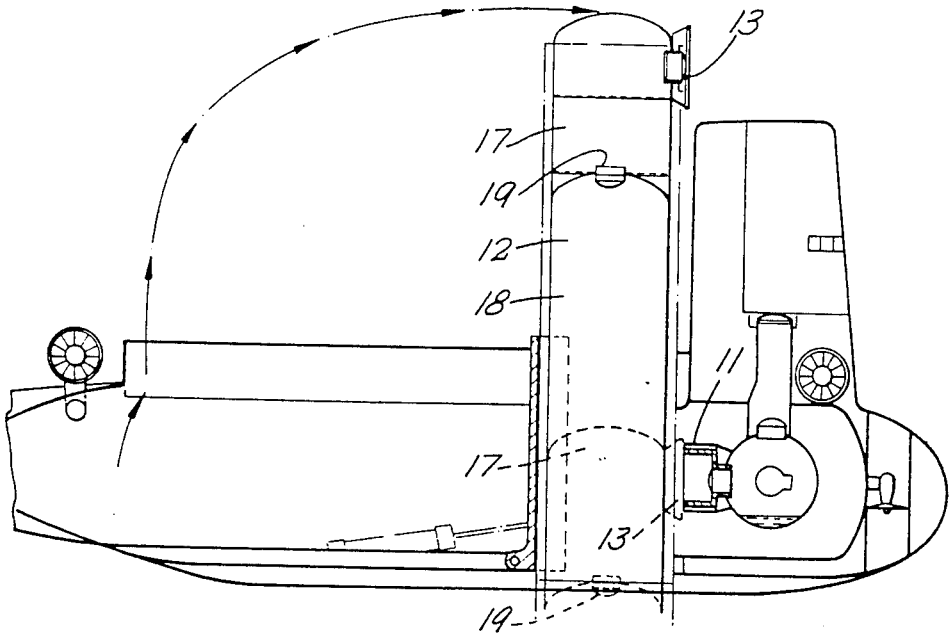
FIG. 6 shows a section as in FIG. 5, with a cargo module being lifted up from a transport position to vertical position.

In the cross-sections of FIG. 5 and 6 it is shown how a mating flange 11 is arranged in the pressure hull part 3. Correspondingly a similar mating flange 13 is arranged in the cargo module 12 shown in compartment 6, in the form of a monobaric work compartment, the opening of which can be brought in line with and connected to the flange 11 as shown with broken lines in FIG. 6.

In the cargo compartment 6 arrangements are made for a frame 15 being pivoted on a horizontal cross shaft 14 carrying the cargo module 12. In addition the cargo module may be supported/secured by means of connecting means (not shown) between the cargo module and the pressure hulls, as mentioned before in connection with FIG. 1–4.

In FIG. 5 the cargo module 12 is shown in its transport position in compartment 6. When the submarine has arrived at its site of destination where the cargo module 12 will be employed, one proceeds as follows. The hatch 16 is opened and the frame 15 is turned on the cross shaft 14, see FIG. 6. After some rotation the cargo module 12 will in this case have to be pulled somewhat to the left, i.e. towards the rear, before further rotational movement can take place past the mating flange 11. When the cargo module 12 has been moved to the vertical position shown in FIG. 6, it can by means of gears not shown be lowered to the position indicated with broken lines. In this position the flange 13 on the cargo module will be located outside the flange 11 and a connection may take place whereby personnel may gain admittance to the compartment 17. The second compartment 18 of the cargo module is by way of example a work compartment which in general will be filled with water of ambient pressure during transport and rotation and placement on the site. Only when the cargo module 12 is connected to a subsea installation, is the work compartment being emptied and the pressure reduced to normal atmospheric pressure. Personnel may then enter the work compartment through the shown admittance connection 19.

Figure 7:
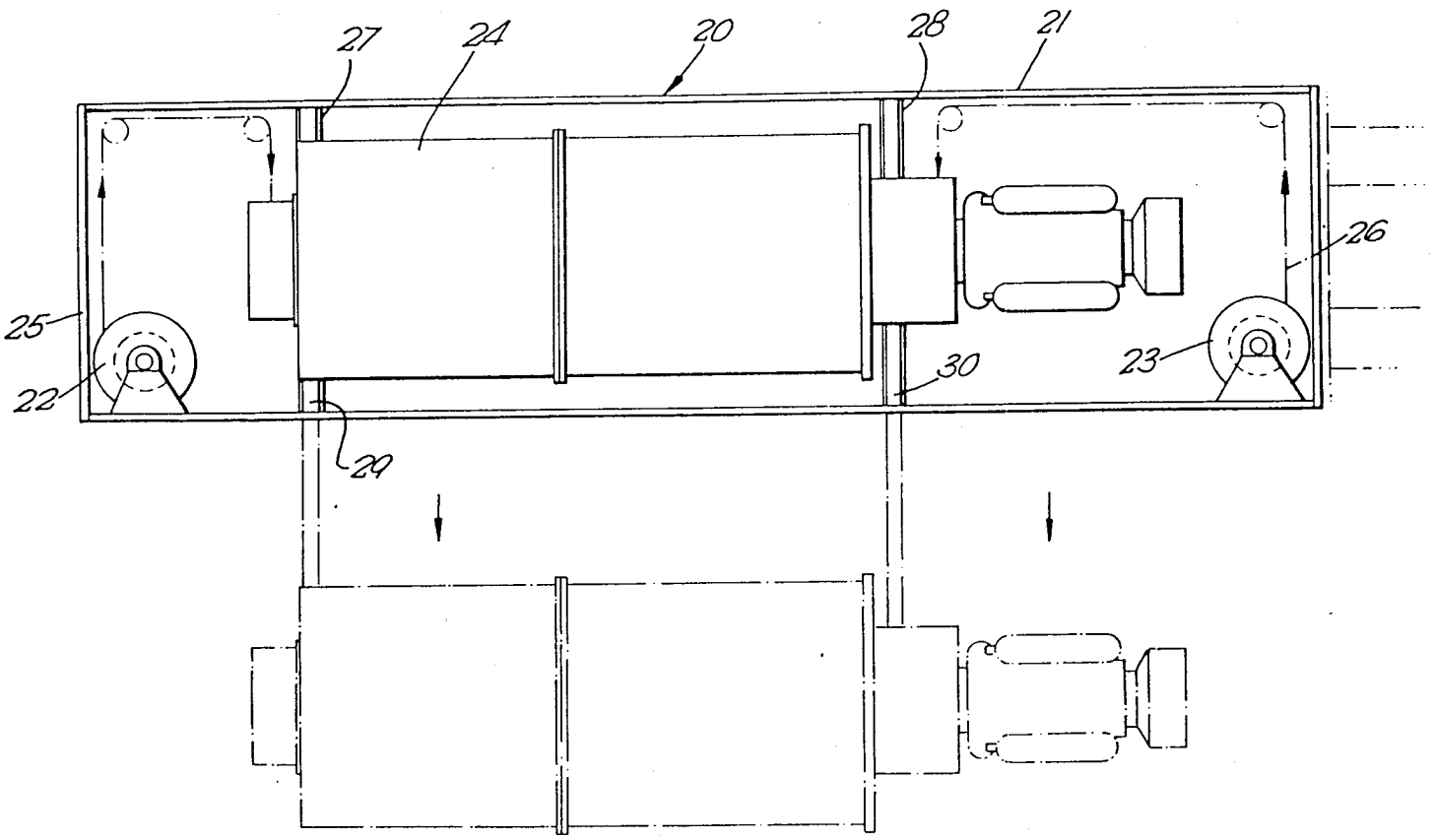
FIG. 7 shows a side view of a cargo module for wet cargo.

In FIG. 7 a side view of the cargo module 20 wet cargo is shown in which the cargo module is constructed as a cage-like framework 21, whose outline corresponds to a "container" form. The framework is provided with handling gears, here shown in the form of two winches 22 and 23. In a way not shown in any further detail the wet components, for instance well equipment 24 are mounted in cargo modules and are being connected to winches 22, 23 through wires 25, 26. With the cargo module 20 being placed in the submarine, by way of example of the type as shown in FIG. 1–4, and with the submarine being placed at the desired location above the seabed, the equipment 24 can be lowered on place by means of the winches, after the bottom in the cargo compartment is opened. Such an operation is indicated by pointed broken lines in the figure. The cargo module 20 is provided with vertical guides 27, 28 for guiding cooperation with telescopical guide rails 29, 30, for guidances of the cargo during lowering. Cargo or equipment can of course be loaded onboard in the same way, only by a reverse procedure.

The previously mentioned embodiments are only considered examples from numerous possibilities which will be evident after studying the preceding text.

The cargo holder may take many different shapes, as required, by way of example a cargo module may be provided with a yoke resting on the two hulls.

We claim:

1. A submarine vehicle comprising:

(a) a first side pressure hull, said first side pressure hull having a front end and a back end, said first side pressure hull being cylindrical in shape;

(b) a second side pressure hull, said second side pressure hull having a front end and a back end, said second side pressure hull being cylindrical in shape, said second side pressure hull spaced away from and parallel to said first side pressure hull, said front end of said first side pressure hull being opposite said front end of said second side pressure hull and said rear end of said first side pressure hull being opposite said rear end of said second side pressure hull;

(c) a front transverse pressure hull, said front transverse pressure hull having one end connected to said front end of said first side pressure hull and said front transverse pressure hull having another end connected to said front end of said second side pressure hull;

(d) a rear transverse member, said rear transverse member having one end connected to said rear end of said first side pressure hull and said rear transverse member having another end connected to said rear end of said second side pressure hull;

(e) an external hull surrounding and connecting said first and said second side pressure hull;

(f) a cargo compartment positioned between said first and second side pressure hull, said first side pressure hull, said second side pressure hull and said cargo compartment having a similar cross-sectional areas and in substantially the same plane, said cargo compartment for carrying a separable cargo module therein;

(g) a frame pivotally mounted between said first and second side pressure hull in said cargo compartment; and (h) means for pivoting said frame between a rest position where said frame is parallel to said first and second side pressure hull and a work position where said frame is substantially perpendicular to first and second side pressure hull, thereby moving said separable cargo module between a rest position where said separable cargo module is parallel to said first and second side pressure hull and a working position where said separable cargo module is substantially perpendicular to said first and second side pressure hull.

2. The submarine vehicle according to claim 1, characterized by the cargo compartment between the two hulls of the submarine comprising a removable top cover, said removable top cover being positioned between said first and said second pressure hull and above said cargo compartment, said removable top cover being removable for loading and unloading of said cargo module; and a removable bottom cover, said removable bottom cover being positioned between said first and said second pressure hull and positioned below said cargo compartment, said removable bottom cover being removable for loading and unloading of said cargo module.

3. The submarine vehicle according to claim 1, characterized by having the submarine provided with supplies for the separable cargo module.

4. The submarine vehicle according to claim 1, characterized by having a bottom cover, said bottom cover being positioned between said first and second side pressure hull and positioned below said cargo compartment, said bottom cover having a hatch therein.

5. The submarine vehicle according to claim 1, characterized by the cargo compartment including means for securing of said separable cargo module.

6. The submarine vehicle according to claim 1, characterized by the cargo module being a separable cargo module in the form of a work compartment.

7. The submarine vehicle according to claim 1, characterized by said front transverse pressure hull having a mating flange in the hull of the submarine intended for connection to a similar flange in a separable cargo module.

8. The submarine vehicle according to claim 7, characterized by having a separable cargo module formed as a work compartment divided into sections, a machinery section and a work section, which machinery section is intended to be kept constantly dry at normal atmospheric pressure and which is provided with a mating flange making it possible to connect the cargo module to the similar mating flange of the submarine when the cargo module is in said working position.

* * * * *